US008562187B2

(12) United States Patent
Smed

(10) Patent No.: US 8,562,187 B2
(45) Date of Patent: Oct. 22, 2013

(54) POWERED BASE FOR A LAMP

(76) Inventor: Ole Falk Smed, Calgary (CA)

( * ) Notice: Subject to any disclaimer, the term of this patent is extended or adjusted under 35 U.S.C. 154(b) by 171 days.

(21) Appl. No.: 13/110,661

(22) Filed: May 18, 2011

(65) Prior Publication Data

US 2012/0294015 A1 Nov. 22, 2012

(51) Int. Cl.
*F21S 8/08* (2006.01)

(52) U.S. Cl.
USPC ..... 362/411; 362/382; 362/419; 315/291

(58) Field of Classification Search
USPC ..... 362/382, 410–414, 418; 315/291; 174/53
See application file for complete search history.

(56) References Cited

U.S. PATENT DOCUMENTS 3,476,931 A * 11/1969 Fletcher ..... 362/411
5,233,271 A * 8/1993 Huang et al. ..... 315/86
5,490,051 A * 2/1996 Messana ..... 362/401
6,888,315 B1 5/2005 Hsiao
7,105,743 B2 9/2006 Caveney
7,456,586 B2 * 11/2008 Morejon ..... 315/247
7,736,033 B2 6/2010 Patel
2004/0012344 A1 1/2004 Bibi
2006/0209530 A1 * 9/2006 Schaak ..... 362/86
2011/0169477 A1 * 7/2011 Radle et al. ..... 324/67

FOREIGN PATENT DOCUMENTS

JP 2003171786 A * 6/2003

* cited by examiner

*Primary Examiner* — Donald Raleigh
(74) *Attorney, Agent, or Firm* — Carl A. Hjort, III

(57) ABSTRACT

Embodiments of a base for a lamp are shown and described, said base including a base member, having an attachment member adapted to attach a combined adjustable arm and lamp to the base member, wherein said base member has a mass sufficient to support the combined adjustable arm and lamp in all possible orientations; at least one outlet module housed in the base member; and a printed circuit board disposed within the base member, said printed circuit electrically connected to a household power outlet, said printed circuit board adapted to electrically connect the at least one outlet module to the household power supply, and wherein said printed circuit board includes a transformer adapted to transform the household power supply into an output power suitable for powering the lamp, and wherein the transformer is electrically connected to the lamp.

17 Claims, 3 Drawing Sheets

POWERED BASE FOR A LAMP

DETAILED DESCRIPTION OF THE DRAWINGS

Embodiments of a powered base for a lamp are shown and described. Generally, the powered base for a lamp comprises a base member, adapted to support a lamp, said base member further comprising an attachment member for securing the lamp to the base member; at least one outlet module housed in the base member; and a transformer disposed within the base member, said transformer including a cord protruding from the base member for connection to a household power outlet, said transformer adapted to transform a household power supply into an output power suitable for powering the lamp, and wherein the transformer is electrically connected to the lamp, and said transformer further comprising a bypass component, wherein the household power supply also bypasses the transformer and is provided to the at least one outlet module. Alternatively, the base may contain a printed circuit board disposed within the base member, said printed circuit board adapted to electrically connect the at least one outlet module with the cord to provide a household power supply to the at least one outlet module, and wherein said printed circuit board includes a transformer adapted to transform the household power supply into an output power suitable for powering the lamp, and wherein the transformer is electrically connected to the lamp head.

Figure 1:
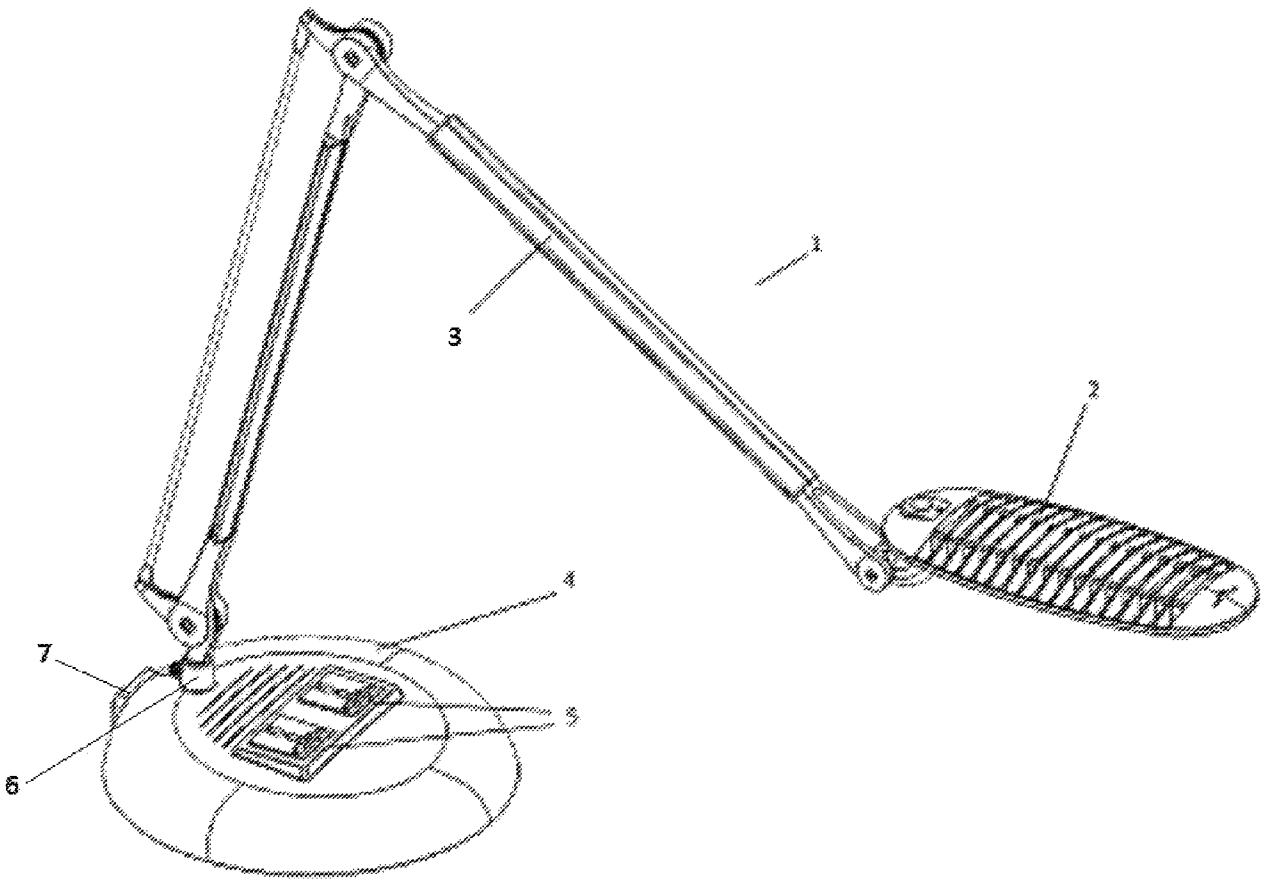
FIG. 1 is a top perspective view of an embodiment of a powered base for a lamp, including a lamp attached thereto.

FIG. 1 shows a top perspective view of an embodiment of a powered base for a lamp, including a lamp attached thereto. In the lamp assembly 1 shown in FIG. 1, a powered base 4 is provided with an adjustable arm 3 and a lamp head 2 connected thereto. Powered base 4 may be constructed from any material that is of sufficient mass to support a lamp including, for example, zinc, aluminum, steel, plastic or wood. The adjustable arm 3 is attached to the powered base 4 by an attachment member 6. As shown in FIG. 1, attachment member 6 may be a raised annular structure which receives an end of the adjustable arm. However, one of ordinary skill in the art will readily appreciate that any connecting device can be used which will securely fasten the adjustable arm to the powered base. Also shown in FIG. 1 is cord connector 7. Cord connector 7 provides for a cord to be releasably connected to the powered base to supply household electrical power to the powered base. By way of example and without limitation, such household electrical power may be between 100 and 240 volts, alternating current, with a frequency between 50 and 60 Hz. In an alternate embodiment of powered base 4, cord connector 7 may be omitted and a cord may be directly wired to the components inside the powered base and protrude from the powered base 4. Additionally, cord connector 7 may be provided with a lamp power output jack, to which be may be connected a wire which carries electrical power to the lamp head 2. A supply of electrical power sufficient for powering the lamp head is provided to the lamp power output jack on the cord connector 7 by a transformer enclosed in the powered base 4, as will be explained in greater detail infra.

Also shown in FIG. 1 are the outlet modules 5. Outlet modules 5 may have any known outlet configuration. By way of example, and without limitation, outlet modules 5 may take the form of a Type A outlet, a Type B outlet, a Type C outlet, a Type D outlet, a Type E outlet, a Type F outlet, a Type E/F hybrid outlet, a Type G outlet, a Type H outlet, a Type I outlet, a Type J outlet, a Type K outlet, a Type L outlet, or a Type M outlet. In an embodiment of the powered base 4, a plurality of outlet modules 5 may be provided in the base. In the case where a plurality of outlet modules 5 are provided, the outlet modules 5 may have all the same outlet configuration or they may have different outlet configurations, each taken from the list set forth above. Any combination of outlet configurations is possible when a plurality of outlet modules 5 are provided.

The powered base 4 may contain a printed circuit board that is electrically connected to the cord connector 7 and receives household electrical power therefrom. In an alternative embodiment, a cord may be directly wired to the printed circuit board and may supply household electrical power in that manner. The printed circuit board may carry on it a transformer, electrically connected to the supply of household electrical power, that transforms the household electrical power into a voltage acceptable for powering the lamp attached to the base. By way of example and without limitation, the output from the transformer may be a 15 volt, direct current output, with a current of 2 Amps. The voltage acceptable for powering the lamp may be output, as described supra, by a lamp power output jack, to which may be connected a wire which carries electrical power to the lamp head 2. One of ordinary skill in the art will readily appreciate that the output from transformer suitable for powering the lamp may be supplied to the lamp by any conventional means known in the art including a connector, direct wiring or any other means. Outlet modules 5 may also be electrically connected to printed circuit board. Household electrical power is provided to outlet modules 5 by the printed circuit board. The household electrical power may bypass the transformer, and be directly routed to the outlet modules 5, for example, by way of direct connection from the cord connector 7 to the outlet module 5. Alternatively, household electrical power may be routed through the transformer and processed before being output to outlet module 5. One of ordinary skill in the art will readily appreciate that either of the above described circuits may be used to provide household electrical power to the outlet modules 5.

Figure 2:
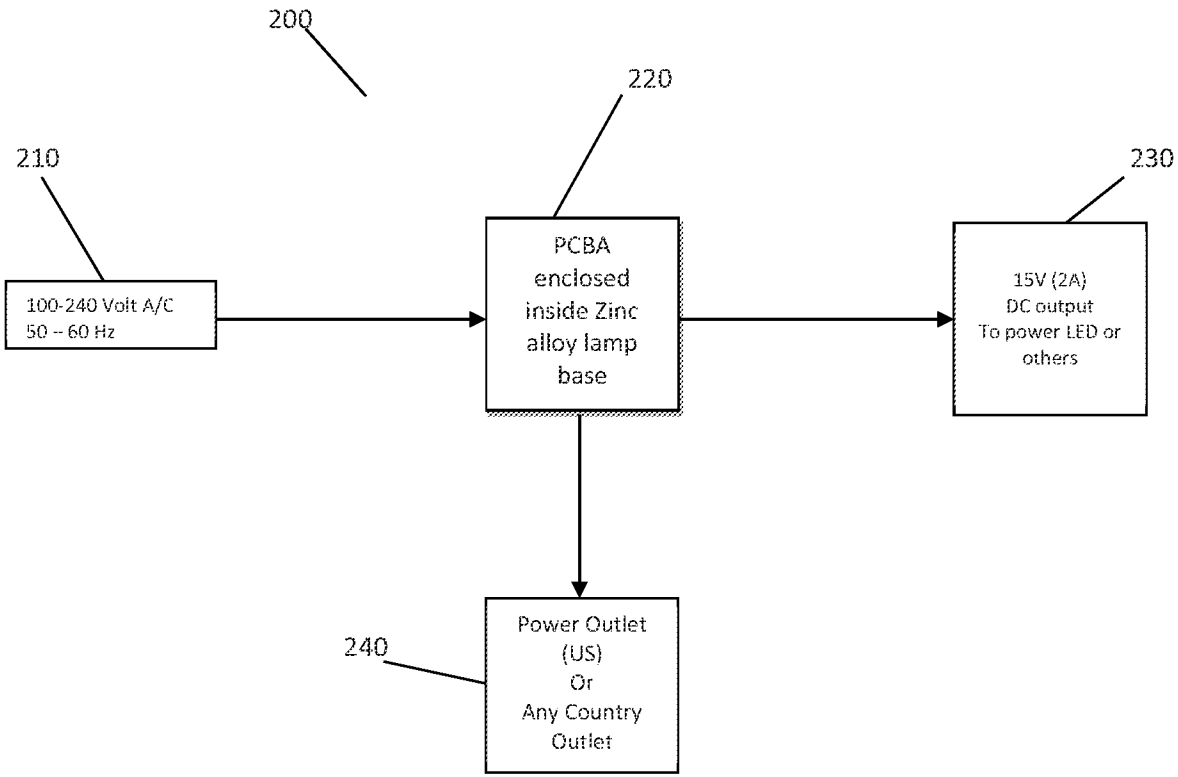
FIG. 2 is a block diagram of an embodiment of a powered base for a lamp.

FIG. 2 shows a block diagram of an embodiment of a powered base for a lamp. As can be seen in FIG. 2, the embodiment of the powered base for a lamp 200 receives a supply of household electrical power 210. By way of example and without limitation, such household electrical power may be between 100 and 240 volts, alternating current, with a frequency between 50 and 60 Hz. The household electrical power feed 210 is supplied by, for example, a cord to printed circuit board 220. The cord may be permanently wired to the circuit board, or a connector may be provided on the circuit board for releasably attaching the cord to the circuit board. Printed circuit board 220 is housed within the base for the lamp, said base being constructed of a material, for example, zinc, that is of sufficient mass to support a lamp. In addition to zinc, one of ordinary skill in the art will readily appreciate that the base can be constructed of any suitable material, including, but not limited to aluminum, steel, plastic or wood. The printed circuit board 220 carries on it a transformer (not shown) that transforms the household electrical power into a voltage acceptable for powering the lamp attached to the base. By way of example and without limitation, the output from the transformer may be a 15 volt, direct current output, with a current of 2 Amps. The voltage acceptable for powering the lamp may be output by, for example, a connector 230 for connecting a cord attached to the lamp to the transformer output in the powered base. One of ordinary skill in the art will readily appreciate that the output from the transformer suitable for powering the lamp may be supplied to the lamp by any conventional means known in the art including a connector, direct wiring or any other means. Electrically connected to printed circuit board 220 is also power outlet 240. Household electrical power is provided to power outlet 240. The household electrical power may bypass the transformer, and be directly routed to the power outlet 240, for example, by way of direct connection from the household electrical power feed 210 to the power outlet 240. Alternatively, household electrical power feed 210 may be routed through transformer (not shown) and processed before being output to power outlet 240. One of ordinary skill in the art will readily appreciate that either of the above described circuits may be used to provide household electrical power to the power outlet 240. Power outlet 240 may have any known outlet configuration. By way of example, and without limitation, power outlet 240 may take the form of a Type A outlet, a Type B outlet, a Type C outlet, a Type D outlet, a Type E outlet, a Type F outlet, a Type E/F hybrid outlet, a Type G outlet, a Type H outlet, a Type I outlet, a Type outlet, a Type K outlet, a Type L outlet, or a Type M outlet. In an embodiment of the powered base for a lamp, a plurality of power outlets 240 may be provided in the base. In the case where a plurality of power outlets 240 are provided, the power outlets 240 may have all the same outlet configuration or they may have different outlet configurations, each taken from the list set forth above. Any combination of outlet configurations is possible when a plurality of power outlets 240 are provided.

In another embodiment of a powered base for a lamp (not shown) in place of or in addition to power outlets 240, universal serial bus (USE) ports may be provided which provide a USE electrical power output. By way of example and without limitation, such USE electrical power output may be a 5V 2A power output. The USE electrical power output may be produced by a USE transformer, electrically coupled to the household electrical power feed 210, the output of the USB transformer being electrically coupled to at least one USE port. Alternatively, the transformer (not shown) that produces the voltage acceptable for powering the lamp may also be adapted for transforming electrical power to a USE electrical power output, and the transformer may be electrically coupled to at least one USB port.

Figure 3:
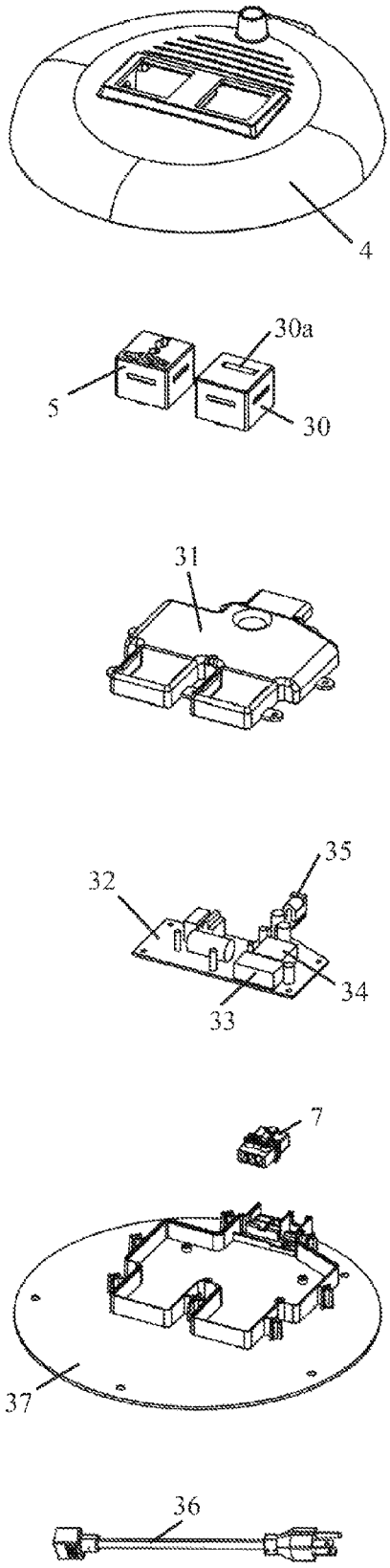
FIG. 3 is an exploded view of an embodiment of a powered base for a lamp.

FIG. 3 shows an exploded view of an embodiment of a powered base for a lamp. Where applicable, like numerals will be used to identify components already identified in FIGS. 1 and 2. Thus the powered base 4 includes module 5. As pointed out above and shown in FIG. 3 in place of one of the outlet modules, there may be provided a USB module 30. USB module 30 includes a USB port 30*a*. USB module 30 and outlet module 5 may be supported in cover 31. Both USB module 30 and outlet module 5 are electrically coupled to printed circuit board 32. In this way, the USB port 30*a* in the USB module 30 is electrically connected to the printed circuit board 32 and the electrical components disposed thereon. Disposed upon printed circuit board 32 is transformer 33. As described above, transformer 33 transforms the household electrical power into a voltage acceptable for powering the lamp attached to the base. By way of example and without limitation, the output from the transformer may be a 15 volt, direct current output, with a current of 2 Amps. Also shown in FIG. 3 is optional USB transformer 34. As stated above, the USB transformer 34 may be electrically coupled to the household electrical power feed and the output of the USB transformer 34 may be electrically coupled to the USB module 30. Alternatively the USB transformer 34 may not be provided and in that case, the transformer 33 that produces the voltage acceptable for powering the lamp may also be adapted for transforming electrical power to a USB electrical power output, and the transformer 33 may be electrically coupled to the USB module 30.

Also shown in FIG. 3 is the cord 36. Cord 36 may take the form of any standard power cord for connecting the powered base assembly to a household power supply, e.g. a standard wall outlet. Cord connector 7 is provided and connects cord 36 to cord connector receptacle 35. In this way, household power is provided by cord 36 to printed circuit board 32. The household power is provided to the components located on printed circuit board 32, i.e. the transformer 33 and, optionally, the USB transformer 34. This household power may also be provided, through the printed circuit board, to outlet module 5. Finally, base plate 37 retains all of the above described components inside of the powered base 4.

It will be appreciated by those of ordinary skill in the art that, while the forgoing disclosure has been set forth in connection with particular embodiments and examples, the disclosure is not intended to be necessarily so limited, and that numerous other embodiments, examples, uses, modifications and departures from the embodiments, examples and uses described herein are intended to be encompassed by the claims attached hereto. Various features of the disclosure are set forth in the following claims.

I claim:

1. A base for a lamp comprising:

a base member, adapted to support a lamp, said base member further comprising an attachment member for securing the lamp to the base member;

at least one outlet module housed in the base member;

a transformer disposed within the base member, said transformer including a cord protruding from the base member for connection to a household power outlet, said transformer adapted to transform a household power supply into an output power suitable for powering the lamp, and wherein the transformer is electrically connected to the lamp, and said transformer further comprising a bypass component, wherein the household power supply also bypasses the transformer and is provided to the at least one outlet module; and wherein the base member further comprises a Universal Serial Bus (USB) module, electrically coupled to the transformer and wherein the transformer is further adapted for transforming electrical power to a voltage suitable for distribution through a USB port, and the transformer is electrically coupled to at least one USB port in the USB module.

2. The base for a lamp of claim 1, wherein the outlet module has at least one configuration selected from the group consisting of a Type A outlet, a Type B outlet, a Type C outlet, a Type D outlet, a Type E outlet, a Type F outlet, a Type E/F hybrid outlet, a Type G outlet, a Type H outlet, a Type I outlet, a Type J outlet, a Type K outlet, a Type L outlet, and a Type M outlet.

3. The base for a lamp of claim 1, wherein the base member is formed from a material selected from the group consisting of zinc, aluminum, steel, plastic and wood.

4. The base for a lamp of claim 1, wherein the base member further comprises a connector for connecting the cord to the transformer, and wherein the cord is releasably connected to the connector.

5. The base for a lamp of claim 1, wherein the output power suitable for powering the lamp is a 15 volt, 2 amp, direct current output.

6. The base for a lamp of claim 1, wherein said USE module includes a USE transformer for transforming electrical power to a voltage suitable for distribution through a USB port, and the USB transformer is electrically coupled to at least one USB port.

7. A base for a lamp comprising:

a base member, having an attachment member adapted to attach a combined adjustable arm and lamp to the base member, wherein said base member is formed from an alloy of zinc, and has a mass sufficient to support the combined adjustable arm and lamp in all possible orientations of the combined adjustable arm and lamp;

at least one outlet module housed in the base member;

a printed circuit board disposed within the base member, said printed circuit board including a cord protruding from the base member for connection to a household power outlet, said printed circuit board adapted to electrically connect the at least one outlet module with the cord to provide a household power supply to the at least one outlet module, and wherein said printed circuit board includes a transformer adapted to transform the household power supply into an output power suitable for powering the lamp, and wherein the transformer is electrically connected to the lamp; and wherein the base member further comprises a Universal Serial Bus (USB) module, electrically coupled to the transformer and wherein the transformer is adapted for transforming electrical power to a voltage suitable for distribution through a USB port, and the transformer is electrically coupled to at least one USB port in the USE module.

8. The base for a lamp of claim 7, wherein the outlet module has at least one configuration selected from the group consisting of a Type A outlet, a Type B outlet, a Type C outlet, a Type D outlet, a Type E outlet, a Type F outlet, a Type E/F hybrid outlet, a Type G outlet, a Type H outlet, a Type I outlet, a Type J outlet, a Type K outlet, a Type L outlet, and a Type M outlet.

9. The base for a lamp of claim 7, wherein the printed circuit board further comprises a connector for connecting the cord to the printed circuit board, and wherein the cord is releasably connected to the connector.

10. The base for a lamp of claim 7, wherein the output power suitable for powering the lamp is a 15 volt, 2 amp, direct current output.

11. The base for a lamp of claim 7, wherein said USB module includes a USB transformer for transforming electrical power to a voltage suitable for distribution through a USB port, and the USB transformer is electrically coupled to at least one USB port.

12. A lamp assembly comprising:

a lamp head having a housing;

an adjustable arm, having a first end and a second end and wherein the first end is attached to the housing;

a mounting member adapted to secure the second end of the adjustable arm to a base member, wherein said base member has a mass sufficient to support the adjustable arm and the lamp head in all possible orientations of the adjustable arm and the lamp head;

at least one outlet module housed in the base member;

a printed circuit board disposed within the base member, said printed circuit board including a cord protruding from the base member for connection to a household power outlet, said printed circuit board adapted to electrically connect the at least one outlet module with the cord to provide a household power supply to the at least one outlet module, and wherein said printed circuit board includes a transformer adapted to transform the household power supply into an output power suitable for powering the lamp, and wherein the transformer is electrically connected to the lamp head; and wherein the base member further comprises a Universal Serial Bus (USB) module, electrically coupled to the transformer and wherein the transformer is adapted for transforming electrical power to a voltage suitable for distribution through a USB port, and the transformer is electrically coupled to at least one USB port in the USB module.

13. The lamp assembly of claim 12, wherein the outlet module has at least one configuration selected from the group consisting of a Type A outlet, a Type B outlet, a Type C outlet, a Type D outlet, a Type E outlet, a Type F outlet, a Type E/F hybrid outlet, a Type G outlet, a Type H outlet, a Type I outlet, a Type J outlet, a Type K outlet, a Type L outlet, and a Type M outlet.

14. The lamp assembly of claim 12, wherein the base member is formed from a material selected from the group consisting of zinc, aluminum, steel, plastic and wood.

15. The lamp assembly of claim 12, wherein the printed circuit board further comprises a connector for connecting the cord to the printed circuit board, and wherein the cord is releasably connected to the connector.

16. The lamp assembly of claim 12, wherein the output power suitable for powering the lamp is a 15 volt, 2 amp, direct current output.

17. The lamp assembly of claim 12, wherein said USB module includes a USB transformer for transforming electrical power to a voltage suitable for distribution through a USB port, and the USB transformer is electrically coupled to at least one USB port.

* * * * *